US010961040B2

(12) United States Patent
Lee

(10) Patent No.: US 10,961,040 B2
(45) Date of Patent: Mar. 30, 2021

(54) CUP SLEEVE STRUCTURE

(71) Applicant: JSC INTSYS CO., New Taipei (TW)

(72) Inventor: Kun-Chan Lee, New Taipei (TW)

(73) Assignee: JSC INTSYS CO., New Taipei (TW)

( * ) Notice: Subject to any disclaimer, the term of this patent is extended or adjusted under 35 U.S.C. 154(b) by 4 days.

(21) Appl. No.: 16/543,998

(22) Filed: Aug. 19, 2019

(65) Prior Publication Data

US 2020/0239220 A1 Jul. 30, 2020

(30) Foreign Application Priority Data

Jan. 25, 2019 (CN) ..... 201910077412.8

(51) Int. Cl.
*B65D 81/38* (2006.01)
*A47G 23/02* (2006.01)

(52) U.S. Cl.
CPC ..... *B65D 81/3876* (2013.01); *A47G 23/0216* (2013.01)

(58) Field of Classification Search
CPC ..... B65D 81/3876; B65D 81/3881; B65D 81/3879; B65D 81/3886; B65D 25/22; B65D 25/2835; B65D 25/2838; B65D 5/46; A47G 23/0216; A47G 23/0208; A47G 23/02; A47G 2023/0283; A47G 2023/0291; A47G 2023/0275; A47G 19/2288
See application file for complete search history.

(56) References Cited

U.S. PATENT DOCUMENTS 7,819,277 B2 * 10/2010 Hanson ..... A45F 5/10 220/737
8,186,571 B2 * 5/2012 Field ..... A45F 5/00 229/402
8,210,392 B2 * 7/2012 Kang ..... B65D 25/2847 220/738
2009/0126149 A1 * 5/2009 Whittaker ..... B65D 81/3886 16/111.1
2016/0309935 A1 * 10/2016 Chuang ..... A47G 23/0216

* cited by examiner

*Primary Examiner* — Don M Anderson
(74) *Attorney, Agent, or Firm* — Schmeiser, Olsen & Watts, LLP

(57) ABSTRACT

A cup sleeve structure for a cup-shaped container includes a body having a first lateral face and a second lateral face, the first lateral face having a first strap, the second lateral face having a second strap. Inner and outer edges of the first strap and the top end of the first strap each have a cutting line. The tail end of the first strap is connected to a first folding line. Inner and outer edges of the second strap and the top end of the second strap each have a cutting line. The tail end of the second strap is connected to a second folding line. When the first strap and second strap are torn off the first lateral face and second lateral face, respectively, and folded to be above the body. The first strap and second strap are connected by engagement to therefore form a handle.

10 Claims, 8 Drawing Sheets

CUP SLEEVE STRUCTURE

CROSS-REFERENCE TO RELATED APPLICATION

This non-provisional application claims priority under 35 U.S.C. § 119(a) on Patent Application No(s). 201910077412.8 filed in China on Jan. 25, 2019, the entire contents of which are hereby incorporated by reference.

BACKGROUND OF THE INVENTION

1. Field of the Invention

The present disclosure relates to a cup sleeve structure, and in particular to a cup sleeve structure with a handle.

2. Description of the Related Art

In the daily life of a modern society, plenty of people are used to buying hot and cold drinks, such as coffee, at coffee shops, convenience stores and drink shops. To allow consumers to conveniently carry containers which contain hot and cold drinks, the coffee shops, the convenience stores and drink shops provide the customers with plastic bags or other facilities for holding the containers. However, the plastic bags and the other facilities may not environment-friendly, leading to governmental enactment of increasingly strict laws which restrict or even ban the use of the plastic bags and/or the other facilities.

Alternatively, the coffee shops, the convenience stores and drink shops provide thermo-insulated corrugated cup sleeves. The consumers grip the cup sleeves which fit around the containers, so as for the consumers to not only hold the containers but also be protected from burn which might otherwise occur if the drinks therein are hot. However, with the cup sleeve (and thus the container) being held by the consumer by hand, the holding hand cannot fetch any other object; hence, the cup sleeves lack ease of use.

BRIEF SUMMARY OF THE INVENTION

An objective of the present disclosure is to provide a cup sleeve structure whose body has a first lateral face and a second lateral face. The first lateral face has a first strap. The second lateral face has a second strap. The inner and outer edges of the first strap and the top end of the first strap each have a cutting line. The tail end of the first strap is connected to a first folding line. The inner and outer edges of the second strap and the top end of the second strap each have a cutting line. The tail end of the second strap is connected to a second folding line. When the first strap and the second strap are torn off the first lateral face and the second lateral face, respectively, and folded to be above the body, the first strap and the second strap are connected by engagement to therefore form a handle; hence, the user can grip the handle and thus carry the cup-shaped container fitted into the cup sleeve. Therefore, the present disclosure effectively reduces the instances of use of plastic bags and the other facilities and enhances the ease of use of cup-shaped containers.

Another objective of the present disclosure is to provide a cup sleeve structure which provides bodies each fitting around a cup-shaped container. When the first straps and second straps of the bodies are torn off lateral faces of the bodies, respectively, a hollowed-out portion is formed on each lateral face of each body. The first strap and second strap of the highest body are folded to be above the highest body, the first strap and second strap of the highest body engage with each other to form a handle. When the first straps and second straps of the other bodies are folded up, the first straps and second straps of the other bodies pass through the hollowed-out portions of the lateral faces of the bodies above and thus get fixed to connection structures between the lateral faces of the bodies above so as to be hung thereon. Afterward, the user grips the handle of the highest body and thus carries cup-shaped containers.

To achieve at least the above objective, the present disclosure provides a cup sleeve structure, comprising: a body being a conical hollow-core body and having a first lateral face and a second lateral face, wherein the body fits around a cup-shaped container; a first strap disposed on the first lateral face and having an inner edge and an outer edge, the inner edge having a first inner cutting line, and the outer edge having a first outer cutting line, with a first folding line connected between an end of the first inner cutting line and an end of the first outer cutting line, and a first top end cutting line connected between another end of the first inner cutting line and another end of the first outer cutting line; and a second strap disposed on the second lateral face and having an inner edge and an outer edge, the inner edge having a second inner cutting line, the outer edge having a second outer cutting line, with a second folding line connected between an end of the second inner cutting line and an end of the second outer cutting line, and a second top end cutting line connected between another end of the second inner cutting line and another end of the second outer cutting line, wherein the first strap and the second strap together form a handle, as soon as the first strap and the second strap are folded to be above the body and connected together by engagement.

In an embodiment of the present disclosure, the first strap comprises a first top portion, a first middle portion and a first tail portion, the first middle portion is disposed between the first top portion and the first tail portion, an end of the first top portion is defined as a top end of the first strap, another end of the first top portion is connected to an end of the first middle portion, an end of the first tail portion is defined as a tail end of the first strap and connected to the first folding line, another end of the first tail portion is connected to another end of the first middle portion, wherein the second strap comprises a second top portion, a second middle portion and a second tail portion, the second middle portion is disposed between the second top portion and the second tail portion, an end of the second top portion is defined as a top end of the second strap, another end of the second top portion is connected to an end of the second middle portion, an end of the second tail portion is defined as a tail end of the second strap and connected to the second folding line, and another end of the second tail portion is connected to another end of the second middle portion.

In an embodiment of the present disclosure, a first included angle is formed between the first middle portion and the first top portion, a second included angle is formed between the first middle portion and the first tail portion, a third included angle is formed between the second middle portion and the second top portion, a fourth included angle is formed between the second middle portion and the second tail portion, and the first, second, third and fourth included angles each range from 90° to 135°.

In an embodiment of the present disclosure, a width of the first strap and a width of the second strap range from 0.8 cm to 3 cm.

In an embodiment of the present disclosure, a bottom portion of the body uses a horizontal line as a standard, and a gradient of the first folding line or the second folding line ranges from 20° to 40°.

In an embodiment of the present disclosure, an inner edge of the first top portion of the first strap has a first inner notch whereby the first strap engages with the outer edge of the second strap as soon as the first strap and the second strap are folded to be above the body.

In an embodiment of the present disclosure, an outer edge of the second top portion of the second strap has a second outer notch such that the first strap and the second strap are connected by engagement of the first inner notch and the second outer notch as soon as the first strap and the second strap are folded to be above the body.

In an embodiment of the present disclosure, a top end of the first top portion of the first strap is an arcuate protruding element, the second top portion of the second strap has an arcuate opening element, such that the first strap and the second strap are connected by engagement of the arcuate protruding element and the arcuate opening element as soon as the first strap and the second strap are folded to be above the body.

In an embodiment of the present disclosure, the body is made of a bilayered paperboard.

In an embodiment of the present disclosure, the body is made of a corrugated paperboard.

The present disclosure further provides a cup sleeve structure, comprising: a first body; at least one second body, wherein the first body and the at least one second body are each a conical hollow-core body and each comprise a first lateral face and a second lateral face, the first body fitting around a first cup-shaped container, the at least one second body each fitting around a second cup-shaped container; a first strap disposed on the first lateral faces of the first body and the at least one second body each and having an inner edge and an outer edge, the inner edge having a first inner cutting line, the outer edge having a first outer cutting line, with a first folding line connected between an end of the first inner cutting line and an end of the first outer cutting line, and a first top end cutting line connected between another end of the first inner cutting line and another end of the first outer cutting line; and a second strap disposed on the second lateral faces of the first body and the at least one second body each and having an inner edge and an outer edge, the inner edge having a second inner cutting line, the outer edge having a second outer cutting line, with a second folding line connected between an end of the second inner cutting line and an end of the second outer cutting line, and a second top end cutting line connected between another end of the second inner cutting line and another end of the second outer cutting line, wherein, as soon as the first straps and the second straps are torn off the first lateral faces and the second lateral faces, respectively, a hollowed-out portion is formed on each said first lateral face and each said second lateral face, wherein a first top portion of each said first strap comprises a first inner notch, a second top portion of each said second strap comprises a second inner notch, the first strap and the second strap of the first body engage with each other through the first inner notch or the second inner notch to form a handle as soon as the first strap and the second strap of the first body are folded to be above the first body, wherein, as soon as the first strap and the second strap of the at least one second body are folded to be above the at least one second body, the first top portion of the first strap of the at least one second body inserts into a gap between the first body and the first cup-shaped container from the hollowed-out portion of the first lateral face or the second lateral face of the first body and exits the hollowed-out portion of the second lateral face or the first lateral face of the first body, wherein the first inner notch of the first strap of the at least one second body is engageably fixed to a connection structure between the first lateral face and the second lateral face of the first body, the second top portion of the second strap of the at least one second body inserts into a gap between the first body and the first cup-shaped container from the hollowed-out portion of the second lateral face or the first lateral face of the first body and exits the hollowed-out portion of the first lateral face or the second lateral face of the first body, wherein the second inner notch of the second strap of the at least one second body is engageably fixed to a connection structure between the first lateral face and the second lateral face of the first body.

DETAILED DESCRIPTION OF THE INVENTION

Figure 1:
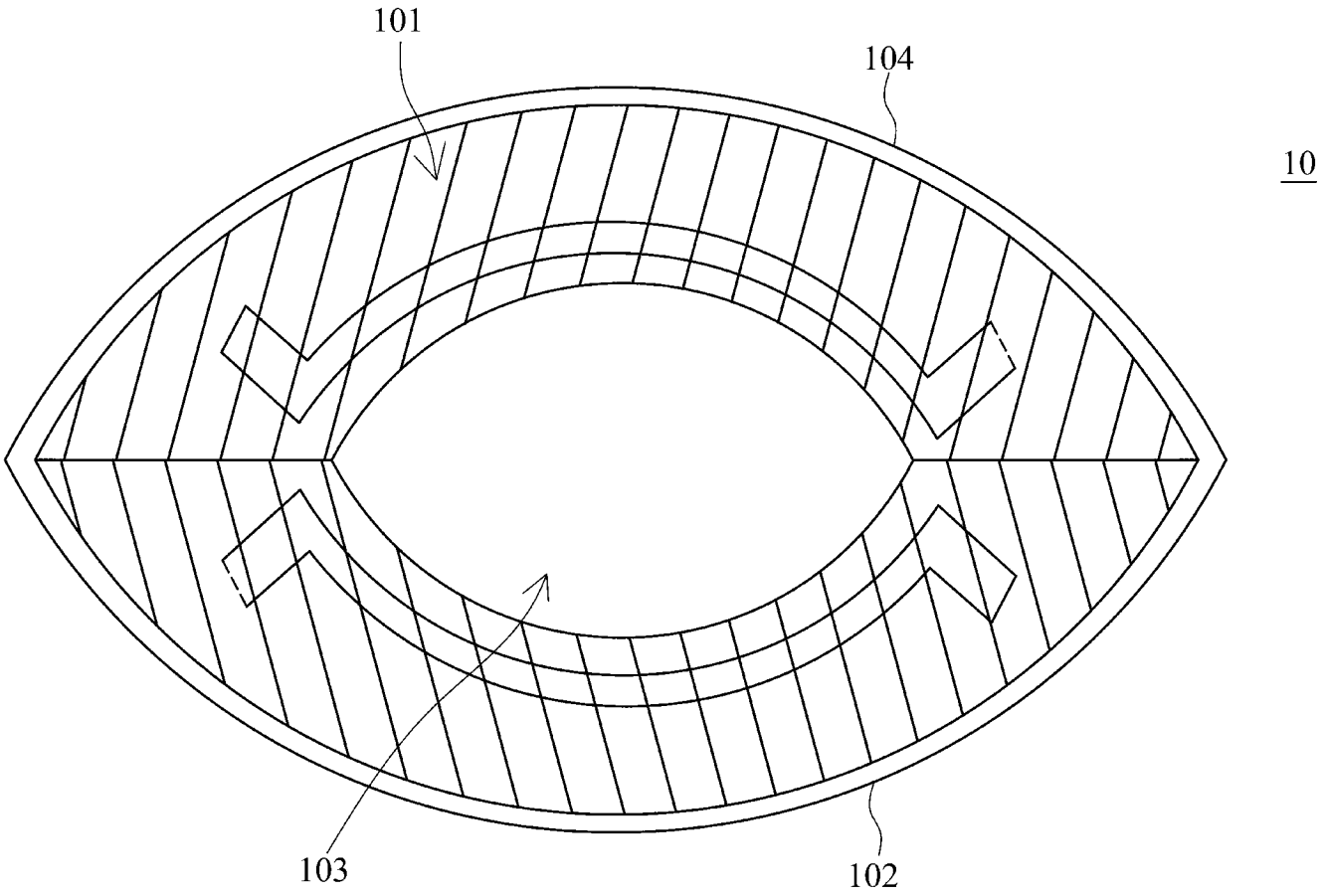
FIG. 1 is a top view of a cup sleeve according to an embodiment of the present disclosure.
Figure 2:
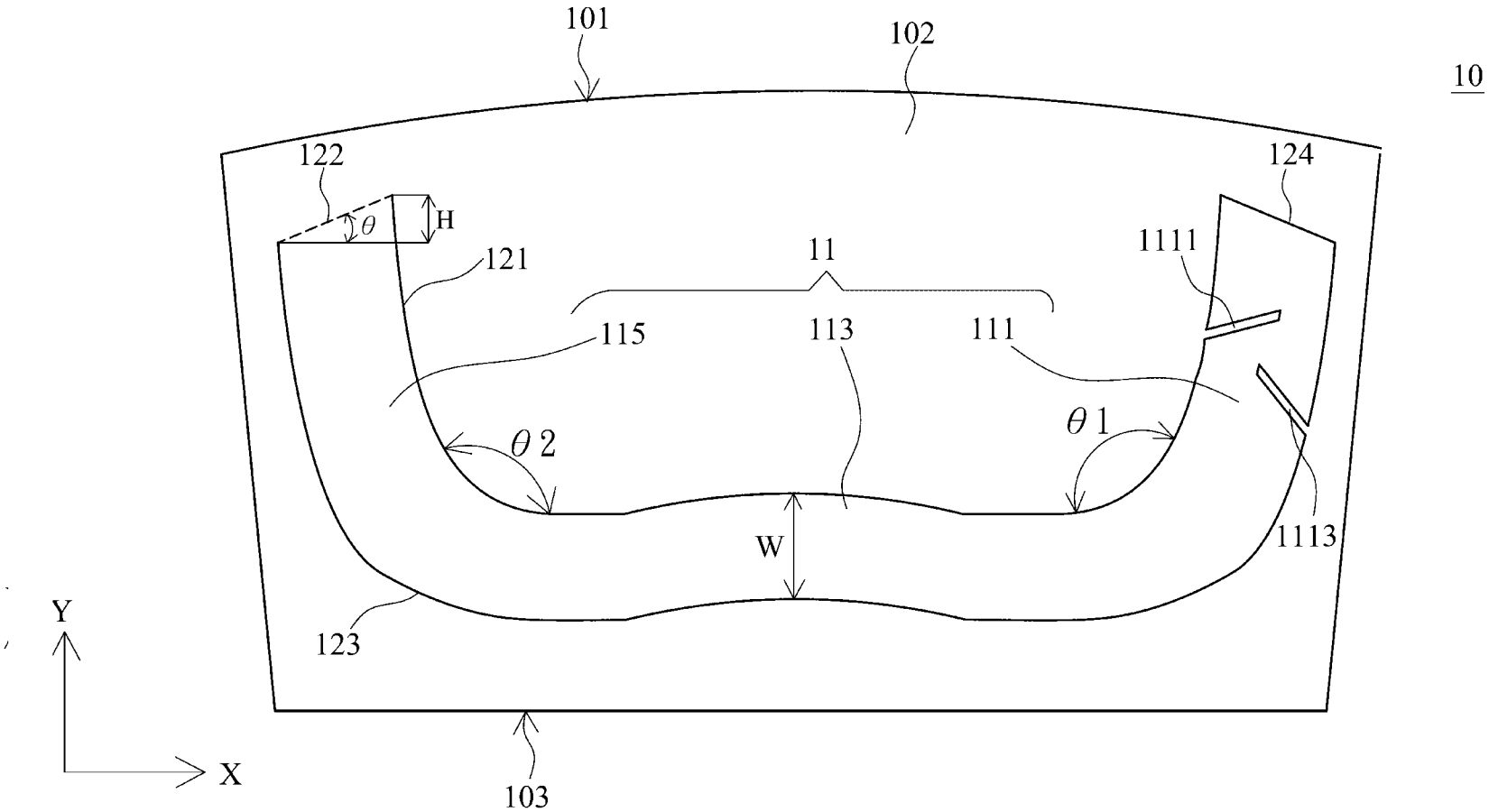
FIG. 2 is a front view of the cup sleeve according to an embodiment of the present disclosure.
Figure 3:
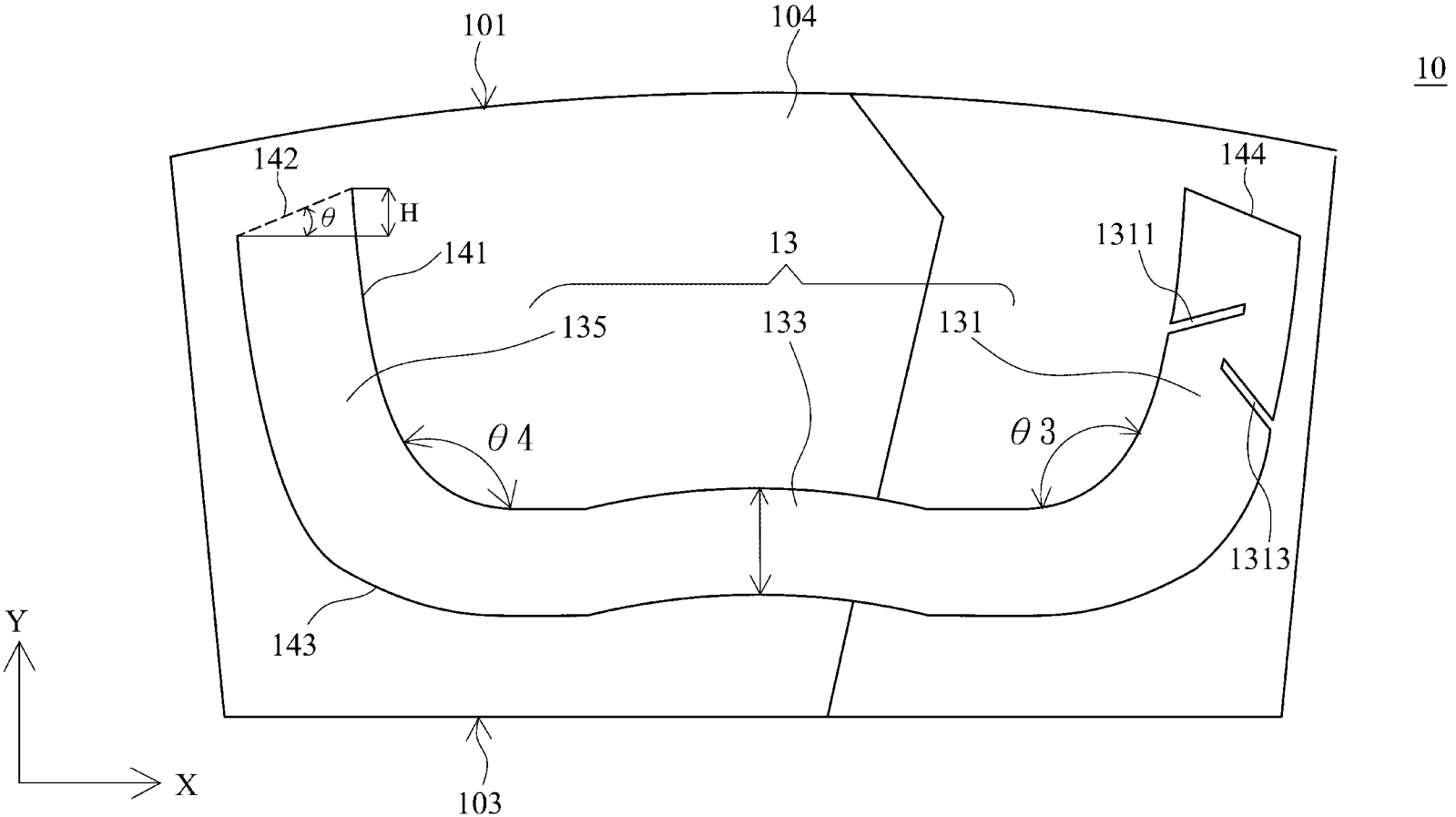
FIG. 3 is a rear view of the cup sleeve according to an embodiment of the present disclosure.
Figure 4:
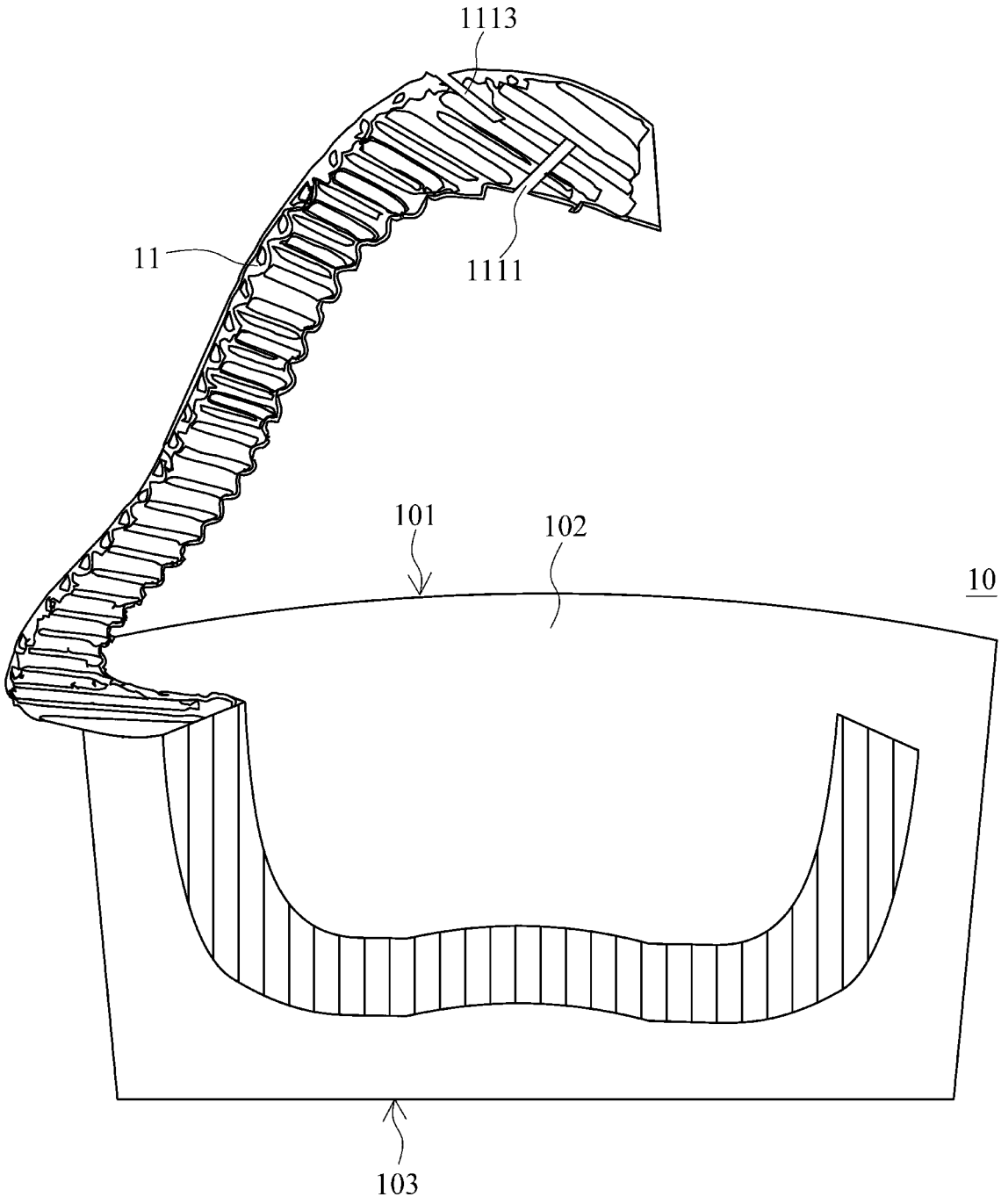
FIG. 4 is a schematic view of how the cup sleeve looks like after its first strap has been torn off along a cutting line.
Figure 5:
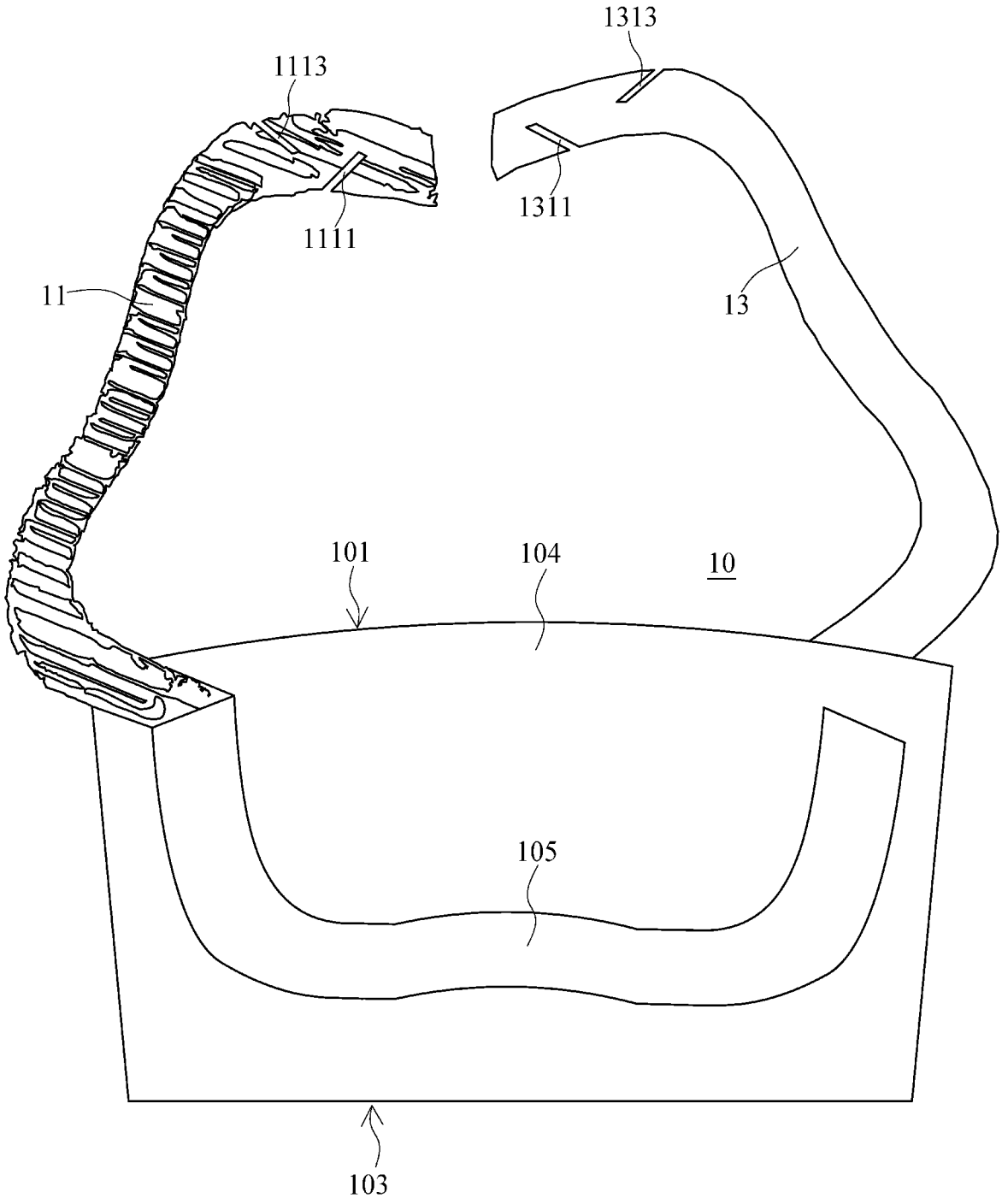
FIG. 5 is a schematic view of how the cup sleeve looks like after its first strap and second strap have been torn off along cutting lines.

Referring to FIG. 1, FIG. 2, FIG. 3, FIG. 4, FIG. 5, and FIG. 6, there are shown a top view, front view, and rear view of a cup sleeve according to an embodiment of the present disclosure, a schematic view of how the cup sleeve looks like after its first strap has been torn off along a cutting line, a schematic view of how the cup sleeve looks like after its first strap and second strap have been torn off along cutting lines, and a perspective view of how the cup sleeve with a handle according to the present disclosure is applied to carrying a cup-shaped container. As shown in FIG. 1 through FIG. 6, the cup sleeve with a handle according to an embodiment of the present disclosure comprises a body 10, a first strap 11 and a second strap 13. The body 10, which is conical and hollow-core, comprises an upper opening 101 and a lower opening 103. The upper opening 101 has a greater diameter than the lower opening 103. A cup-shaped container 20 can pass through the upper opening 101 to enter the body 10 such that the body 10 fits around the cup-shaped container 20.

The body 10 has a first lateral face 102 and a second lateral face 104. The first strap 11 is disposed on the first lateral face 102. The first strap 11 has an inner edge which comes with a first inner cutting line 121 and an outer edge which comes with a first outer cutting line 123. A first folding line 122 is connected between one end of the first inner cutting line 121 and one end of the first outer cutting line 123. A first top end cutting line 124 is connected between the other end of the first inner cutting line 121 and the other end of the first outer cutting line 123. The second strap 13 is disposed on the second lateral face 104. The second strap 13 has an inner edge which comes with a second inner cutting line 141 and an outer edge which comes with a second outer cutting line 143. A second folding line 142 is connected between one end of the second inner cutting line 141 and one end of the second outer cutting line 143. A second top end cutting line 144 is connected between the other end of the second inner cutting line 141 and the other end of the second outer cutting line 143.

To use the cup sleeve to carry the cup-shaped container 20, the user tears off the first strap 11 along the first top end cutting line 124, first inner cutting line 121 and first outer cutting line 123 on the first lateral face 103 and then folds the first strap 11 along the first folding line 122 until the first strap 11 is above the body 10. Afterward, the user tears off the second strap 13 along the second top end cutting line 144, second inner cutting line 141 and second outer cutting line 143 on the second lateral face 104 and then folds the second strap 13 along the second folding line 142 until the second strap 13 is above the body 10. After both the first strap 11 and second strap 13 have been folded to be above the body 10 (for example, above the upper opening 101), the first strap 11 and second strap 13 are connected by engagement to therefore form a handle 15. Therefore, the user uses the handle 15 of the cup sleeve to carry the cup-shaped container 20. After the first strap 11 and second strap 13 have been torn off the first lateral face 102 and second lateral face 104 of the body 10, the first lateral face 102 and second lateral face 104 each form thereon a hollowed-out portion 105.

The first strap 11 is substantially W-shaped and comprises a first top portion 111, a first middle portion 113 and a first tail portion 115. The first top portion 111 and the first tail portion 115 flank the first middle portion 113 symmetrically or asymmetrically. The middle of the first middle portion 113 elevates slightly. One end of the first top portion 111 is defined as the top end of the first strap 11. The other end of the first top portion 111 is connected to one end of the first middle portion 113. One end of the first tail portion 115 is defined as the tail end of the first strap 11 and connected to the first folding line 122. The other end of the first tail portion 115 is connected to the other end of the first middle portion 113. Similarly, the second strap 13 is substantially W-shaped and comprises a second top portion 131, a second middle portion 133 and a second tail portion 135. The second top portion 131 and second tail portion 135 flank the second middle portion 133 symmetrically or asymmetrically. The middle of the second middle portion 133 elevates slightly. One end of the second top portion 131 is defined as the top end of the second strap 13. The other end of the second top portion 131 is connected to one end of the second middle portion 133. One end of the second tail portion 135 is defined as the tail end of the second strap 13 and connected to the second folding line 142. The other end of the second tail portion 135 is connected to the other end of the second middle portion 133. A first included angle (01) is formed between the first middle portion 113 and first top portion 111. A second included angle (02) is formed between the first middle portion 113 and first tail portion 115. A third included angle (03) is formed between the second middle portion 133 and second top portion 131. A fourth included angle (04) is formed between the second middle portion 133 and second tail portion 135. In an embodiment of the present disclosure, the first included angle (01), second included angle (02), third included angle (03) and fourth included angle (04) each range from 90° to 135°.

In an embodiment of the present disclosure, the width (W) of the first strap 11 and second strap 13 ranges from 0.8 cm to 3 cm. Using a horizontal line (for example, X-axis) or the bottom (for example, the lower opening 103) of the body 10 as a standard, there is a height difference (H) between the inner cutting line 121/141 and outer cutting line 123/143. The height difference (H) between the inner cutting line 121/141 and outer cutting line 123/143 is adjusted such that the gradient (θ) of the folding line 122/142 ranges from 20° to 40°. As experiments affirm, according to the present disclosure, the first strap 11 and second strap 13 are selectively folded upward at the gradient (θ=20°~40°) to be above the body 10 such that not only do the first strap 11 and second strap 13 engage with each other smoothly, but the first strap 11 and second strap 13 also appropriately extend outward to allow the handle 15 (formed from the first strap 11 and second strap 13) to have broad room for a grip, allowing the user to bring the cup-shaped container 20 conveniently.

Figure 6:
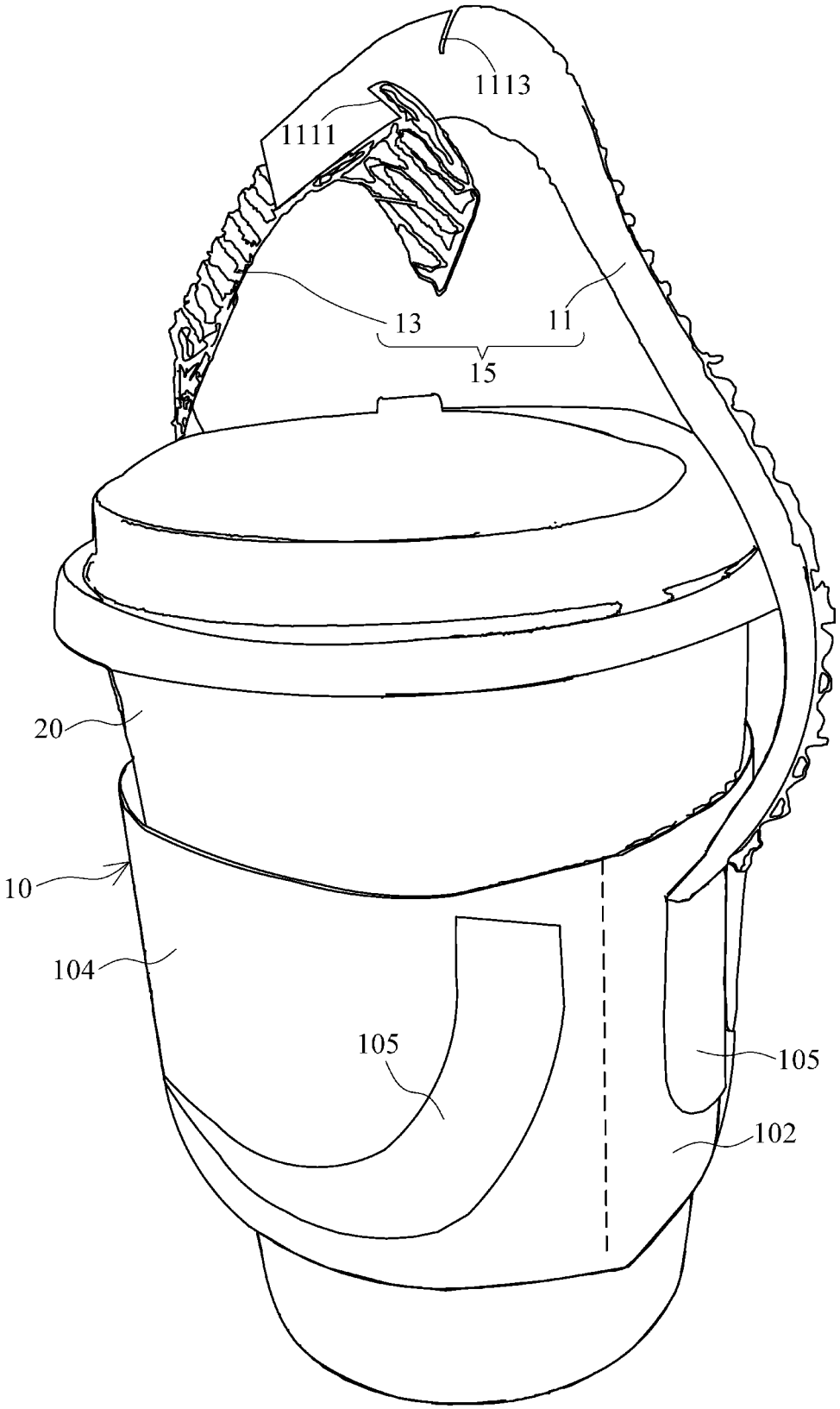
FIG. 6 is a perspective view of how the cup sleeve with a handle according to the present disclosure is applied to carrying a cup-shaped container.

In an embodiment of the present disclosure, the inner edge of the first top portion 111 of the first strap 11 has a first inner notch 1111. When the first strap 11 and second strap 13 are folded to be above the body 10, the first inner notch 1111 of the first strap 11 engages with the outer edge of the second strap 13 such that the first strap 11 and second strap 13 together form the handle 15, as shown in FIG. 6. Alternatively, in another embodiment of the present disclosure, the outer edge of the second top portion 131 of the second strap 13 has a second outer notch 1313 such that the engagement of the first inner notch 1111 of the first strap 11 and the second outer notch 1313 of the second strap 13 augments the engagement of the first strap 11 and second strap 13 to thereby enhance the stability of the handle 15. The outer edge of the first top portion 111 of the first strap 11 has a first outer notch 1113. The inner edge of the second top portion 131 of the second strap 13 has a second inner notch 1311. The user either chooses the engagement of the first inner notch 1111 and second outer notch 1313 or chooses the engagement of the second inner notch 1311 and first outer notch 1113.

In the above embodiment, the first strap 11 and second strap 13 engage with each other by notches. Alternatively, in another embodiment of the present disclosure, the top end of the first top portion 111 of the first strap 11 is in the form of an arcuate protruding element, whereas an arcuate opening element is disposed at the second top portion 131 of the second strap 13. When the first strap 11 and second strap 13 are folded to be above the body 10, the first strap 11 and second strap 13 engage with the arcuate opening element through the arcuate protruding element such that the first strap 11 and second strap 13 engage with each other to form the handle 15. In addition to the aforesaid two ways of engagement, it is also feasible for the first strap 11 and second strap 13 to engage with each other and thus be fixed together.

According to the present disclosure, the body 10 is made of a bilayered paperboard. Preferably, the body 10 is made of a corrugated paperboard. In this embodiment, the cup sleeve is made of a corrugated paperboard to not only achieve satisfactory thermal insulation but also function as the strap 11/13 of the handle 15 to thereby attain satisfactory strength, thereby reducing the chance of severance of the strap 11/13 while the user is using the handle 15 of the cup sleeve to carry the cup-shaped container 20.

Figure 7:
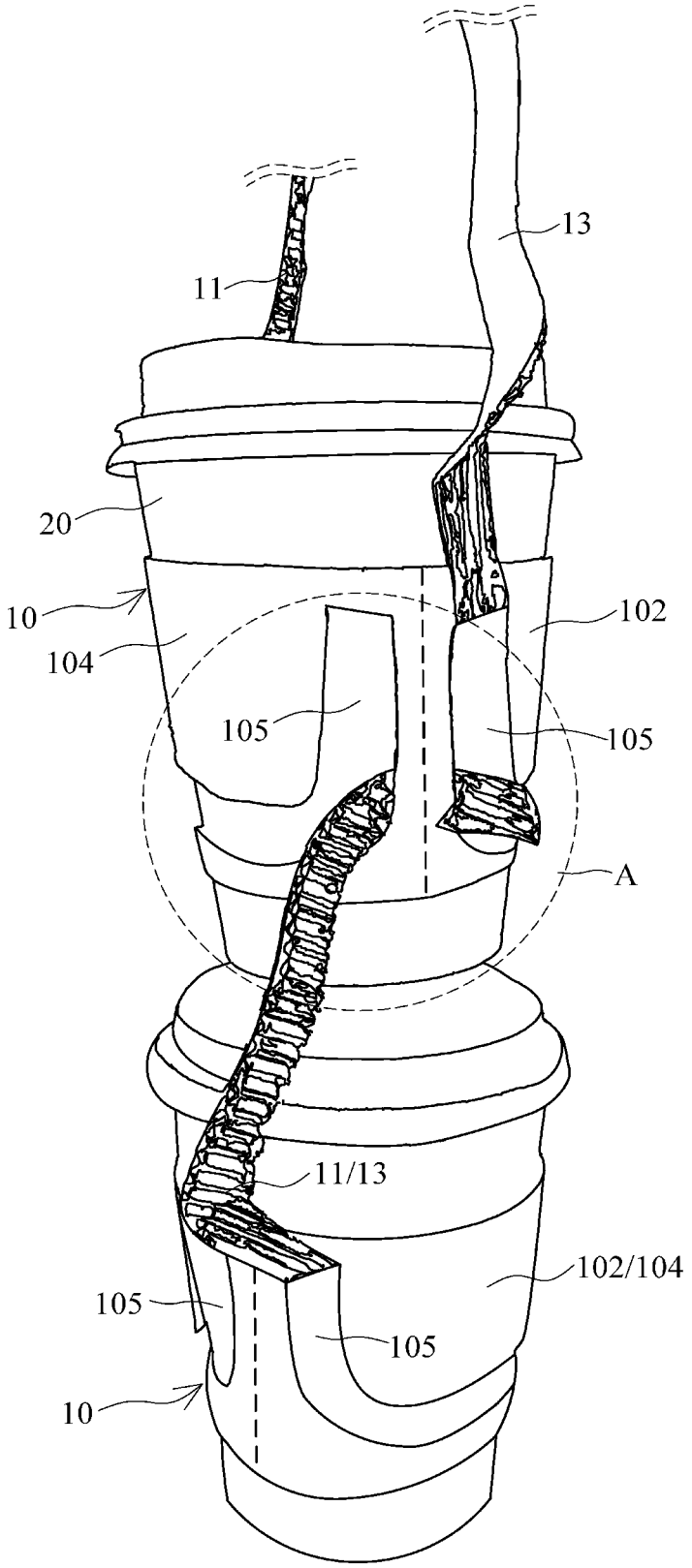
FIG. 7 is a perspective view of how the cup sleeve with a handle according to the present disclosure is applied to carrying cup-shaped containers.
Figure 8:
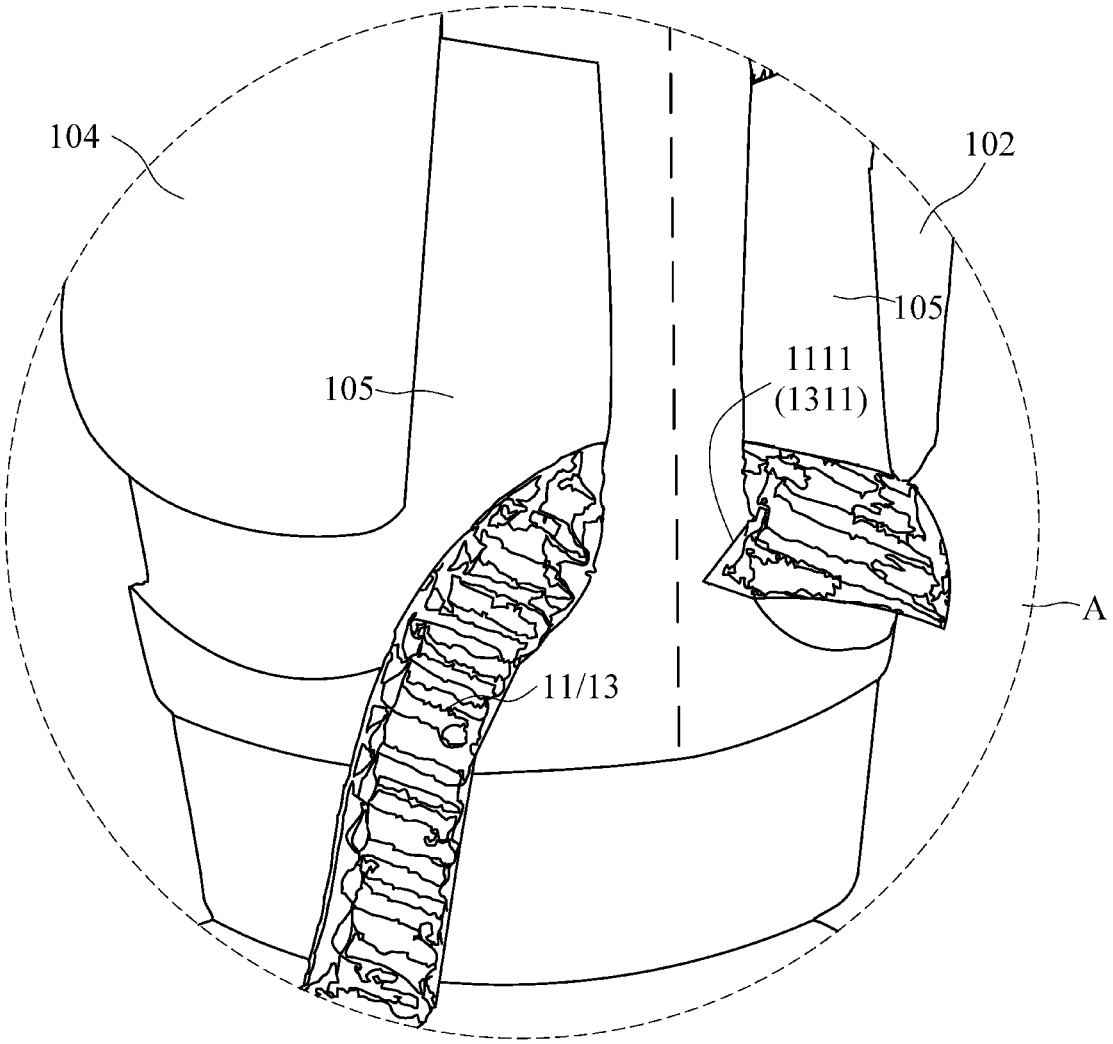
FIG. 8 is an enlarged view of part A in FIG. 7.

Referring to FIG. 7 and FIG. 8, there are shown a perspective view of how the cup sleeve with a handle is applied to carrying out cup-shaped containers and an enlarged view of part A in FIG. 7. Referring to FIG. 6 too, according to the present disclosure, the user uses cup sleeves to carry cup-shaped containers 20. As shown in FIG. 6, FIG. 7 and FIG. 8, the first cup-shaped container 20 fits into the body 10 of the first cup sleeve (for example, the upper cup sleeve) such that the first strap 11 and second strap 13 of the first body 10 engage with each other to form a handle 15. Next, the second cup-shaped container 20 fits into the body 10 of the second cup sleeve (for example, the lower cup sleeve) such that the first top portion 111 of the first strap 11 of the second body 10 inserts into the gap between the first body 10 and the first cup-shaped container 20 from the hollowed-out portion 105 of a lateral face (for example, the second lateral face 104) of the first body 10 and exits another lateral face (for example, the first lateral face 102). Hence, the first inner notch 1111 of the first top portion 111 of the first strap 11 of the second body 10 is engageably fixed to a connection structure between the second lateral face 104 and the first lateral face 102 of the first body 10. Likewise, the second top portion 131 of second strap 13 of the second body 10 inserts into the gap between the first body 10 and the first cup-shaped container 20 from the hollowed-out portion 105 of a lateral face (for example, the first lateral face 102) of the first body 10 and exits another lateral face (for example, the second lateral face 104), such that the second inner notch 1311 of the second top portion 131 of the second strap 13 of the second body 10 is engageably fixed to a connection structure between the second lateral face 104 and the first lateral face 102 of the first body 10 to allow the first strap 11 and second strap 13 of the second body 10 to hang on a connection structure between the lateral faces 102, 104 of the first body 10. Afterward, the user grips the handle 15 of the first body 10 to carry the first cup-shaped container 20 in the first body 10 and the second cup-shaped container 20 in the second body 10 hanging below the first body 10. Alternatively, according to another embodiment of the present disclosure, regarding the second body 10, the first top portion 111 of the first strap 11 and the second top portion 131 of the second strap 13 are selectively stapled and thus fixed to the first lateral face 102 and second lateral face 104 of the first body 10. In addition to the aforesaid two ways of fixing the straps in place, the first top portion 111 of the first strap 11 and the second top portion 131 of the second strap 13, which are positioned below the body 10, can be fixed to the body 10 from above.

While the present disclosure has been described by means of specific embodiments, numerous modifications and variations could be made thereto by those skilled in the art without departing from the scope and spirit of the present disclosure set forth in the claims.

What is claimed is:

1. A cup sleeve structure, comprising:

a body being a conical hollow-core body and having a first lateral face and a second lateral face, wherein the body fits around a cup-shaped container;

a first strap disposed on the first lateral face and having an inner edge and an outer edge, the inner edge having a first inner cutting line, and the outer edge having a first outer cutting line, with a first folding line connected between an end of the first inner cutting line and an end of the first outer cutting line, and a first top end cutting line connected between another end of the first inner cutting line and another end of the first outer cutting line; and a second strap disposed on the second lateral face and having an inner edge and an outer edge, the inner edge having a second inner cutting line, the outer edge having a second outer cutting line, with a second folding line connected between an end of the second inner cutting line and an end of the second outer cutting line, and a second top end cutting line connected between another end of the second inner cutting line and another end of the second outer cutting line, wherein the first strap and the second strap can be linked together to form a handle by folding the first strap and the second strap to be above the body and connected together by engagement.

2. The cup sleeve structure of claim 1, wherein the first strap comprises a first top portion, a first middle portion and a first tail portion, the first middle portion is disposed between the first top portion and the first tail portion, an end of the first top portion is defined as a top end of the first strap, another end of the first top portion is connected to an end of the first middle portion, an end of the first tail portion is defined as a tail end of the first strap and connected to the first folding line, another end of the first tail portion is connected to another end of the first middle portion, wherein the second strap comprises a second top portion, a second middle portion and a second tail portion, the second middle portion is disposed between the second top portion and the second tail portion, an end of the second top portion is defined as a top end of the second strap, another end of the second top portion is connected to an end of the second middle portion, an end of the second tail portion is defined as a tail end of the second strap and connected to the second folding line, and another end of the second tail portion is connected to another end of the second middle portion.

3. The cup sleeve structure of claim 2, wherein a first included angle is formed between the first middle portion and the first top portion, a second included angle is formed between the first middle portion and the first tail portion, a third included angle is formed between the second middle portion and the second top portion, a fourth included angle is formed between the second middle portion and the second tail portion, and the first, second, third and fourth included angles each range from 90° to 135°.

4. The cup sleeve structure of claim 1, wherein a width of the first strap and a width of the second strap range from 0.8 cm to 3 cm.

5. The cup sleeve structure of claim 1, wherein a bottom portion of the body uses a horizontal line as a standard, and a gradient of the first folding line or the second folding line ranges from 20° to 40°.

6. The cup sleeve structure of claim 2, wherein an inner edge of the first top portion of the first strap has a first inner notch, when the first strap and the second strap are folded to be above the body, the first strap engages with the outer edge of the second strap through the first inner notch.

7. The cup sleeve structure of claim 6, wherein an outer edge of the second top portion of the second strap has a second outer notch, when the first strap and the second strap are folded to be above the body, the first strap and the second strap are connected by the engagement of the first inner notch and the second outer notch.

8. The cup sleeve structure of claim 1, wherein the body is made of a bilayered paperboard.

9. The cup sleeve structure of claim 1, wherein the body is made of a corrugated paperboard.

10. A cup sleeve structure, comprising:

a first body;

a second body, wherein the first body and the second body are a conical hollow-core body respectively, and each of the first body and the second body respectively comprise a first lateral face and a second lateral face, the first body fitting around a first cup-shaped container, the second body fitting around a second cup-shaped container;

a plurality of first straps disposed respectively on the first lateral face of the first body and the first lateral face of the second body, wherein each first strap has an inner edge and an outer edge, the inner edge having a first inner cutting line, the outer edge having a first outer cutting line, a first folding line being connected between an end of the first inner cutting line and an end of the first outer cutting line, and a first top end cutting line being connected between another end of the first inner cutting line and another end of the first outer cutting line; and a plurality of second straps disposed respectively on the second lateral face of the first body and the second lateral face of the second body, wherein each second strap has an inner edge and an outer edge, the inner edge having a second inner cutting line, the outer edge having a second outer cutting line, a second folding line being connected between an end of the second inner cutting line and an end of the second outer cutting line, and a second top end cutting line being connected between another end of the second inner cutting line and another end of the second outer cutting line, wherein, the first straps and the second straps are torn off the first lateral faces and the second lateral faces, respectively, a hollowed-out portion is formed on each said first lateral face and each said second lateral face, wherein a first top portion of each said first strap comprises a first inner notch, a second top portion of each said second strap comprises a second inner notch, the first strap and the second strap of the first body engage with each other through the first inner notch or the second inner notch to form a handle by folding the first strap and the second strap of the first body to be above the first body, wherein, when the first strap and the second strap of the second body are folded to be above the second body, the first top portion of the first strap of the second body inserts into a gap between the first body and the first cup-shaped container from the hollowed-out portion of the first lateral face or the second lateral face of the first body and exits the hollowed-out portion of the second lateral face or the first lateral face of the first body, wherein the first inner notch of the first strap of the second body is engageably fixed to a connection structure between the first lateral face and the second lateral face of the first body, the second top portion of the second strap of the second body inserts into a gap between the first body and the first cup-shaped container from the hollowed-out portion of the second lateral face or the first lateral face of the first body and exits the hollowed-out portion of the first lateral face or the second lateral face of the first body, wherein the second inner notch of the second strap of the second body is engageably fixed to a connection structure between the first lateral face and the second lateral face of the first body.

* * * * *